US008545252B2

(12) United States Patent
Wang et al.

(10) Patent No.: US 8,545,252 B2
(45) Date of Patent: Oct. 1, 2013

(54) PLUG CONNECTOR HAVING A RELEASING MECHANISM

(75) Inventors: Chien-Chiung Wang, New Taipei (TW); Qing-Man Zhu, Kunshan (CN); Peng Zhai, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 57 days.

(21) Appl. No.: 13/404,231

(22) Filed: Feb. 24, 2012

(65) Prior Publication Data

US 2012/0220147 A1 Aug. 30, 2012

(51) Int. Cl.
*H01R 13/627* (2006.01)

(52) U.S. Cl.
USPC ..... 439/352

(58) Field of Classification Search
USPC ..... 439/352, 351
See application file for complete search history.

(56) References Cited

U.S. PATENT DOCUMENTS 4,979,909 A * 12/1990 Andrews ..... 439/352
6,648,665 B1 * 11/2003 Wu ..... 439/352
6,749,448 B2 * 6/2004 Bright et al. ..... 439/160
6,824,416 B2 * 11/2004 Di Mascio ..... 439/352
6,851,867 B2 * 2/2005 Pang et al. ..... 385/88
7,040,911 B1 * 5/2006 Ho et al. ..... 439/352
7,090,523 B2 * 8/2006 Shirk et al. ..... 439/352
7,309,250 B2 12/2007 Reed et al.
8,040,687 B2 * 10/2011 Pirillis ..... 361/801
2005/0260880 A1 * 11/2005 Seo et al. ..... 439/372
2006/0078259 A1 * 4/2006 Fuchs ..... 385/88
2011/0081114 A1 4/2011 Togami et al.

* cited by examiner

*Primary Examiner* — Phuong Dinh
(74) *Attorney, Agent, or Firm* — Ming Chieh Chang; Wei Te Chung

(57) ABSTRACT

A plug connector (100) configured for latching with a receptacle having a latching tab includes a housing (1) defining a top wall (14) and two opposite sidewalls (13), and a releasing mechanism (2) assembled to the housing. The releasing mechanism includes a pair of sliders (21) movably attached to the sidewalls, and an extension spring (25) attached to the top wall. The spring has two free ends (250) respectively connected to the sliders. Each of the sliders includes a narrowed and protruded actuating end (211) adapted for releasing the latching tab of the receptacle from the plug connector when the slider moves from a first position to a second position. The movement of the sliders elongates the spring into an extended state at the second position. The extended spring tends to restore the sliders to the first position.

12 Claims, 4 Drawing Sheets

PLUG CONNECTOR HAVING A RELEASING MECHANISM

BACKGROUND OF THE INVENTION

1. Field of the Invention

The present invention generally relates to a plug connector, and more particularly to a plug connector used for high-speed transmission.

2. Description of Related Art

U.S. Pat. No. 6,749,448 issued to Bright et al. on Jun. 15, 2004 discloses an SFP (Small Form-Factor Pluggable) plug adapted for inserting into a receptacle having a latching tab. The SFP plug comprises a releasing mechanism having a pair of substantially parallel actuator arms extending longitudinally along a respective one of opposite side walls of the receptacle. Each of the arms comprises an outwardly extending releasing tab. When the plug is inserted into the receptacle, the latching tab resists against a side wall of the SFP plug. When the plug is extracted from the receptacle, the releasing tab outwardly depresses the latching tab and releases the latching tab to allow the extraction of the plug connector. Each arm defines a channel and has a compression spring received in the channel for providing restoring force to the releasing mechanism.

U.S. Pat. No. 7,309,250 issued to Bruce Reed et al. on Dec. 18, 2007 discloses another electrical module assembly configured for latching with a receptacle assembly. The electrical module assembly comprises a releasing mechanism comprising a pair of parallel actuator arms. A torsion spring has two end portions respectively interconnected to the actuator arms to provide a return force.

In terms of elasticity or spring property of a torsion spring in above-mentioned releasing mechanism, it may be difficult to work with.

Hence, a plug connector having an improved releasing mechanism is desired.

SUMMARY OF THE INVENTION

Accordingly, an object of the present invention is to provide a plug connector with improved releasing mechanism having a quickly replaceable spring.

In order to achieve the above-mentioned object, a plug connector configured for latching engagement with a module receptacle having an inwardly extending latching tab. The plug connector comprises a housing defining a top wall and two opposite sidewalls, and a releasing mechanism assembled to the housing. The releasing mechanism comprises a pair of sliders movably attached to the sidewalls. The sliders are configured to move relative to the sidewalls along a mating direction of the plug connector. Each of the sliders comprises a narrowed and protruded actuating end adapted for releasing the latching tab of the module receptacle when the slider moves from a first position to a second position. The releasing mechanism further comprises an extension spring attached to the top wall. The spring has two free ends respectively connected to the sliders. The movement of the sliders elongates the spring into an extended state at the second position. The extended spring returns the sliders from the second position to the first position. It is convenient to replace the spring from the top wall when the elasticity of the spring is not enough to return the sliders.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
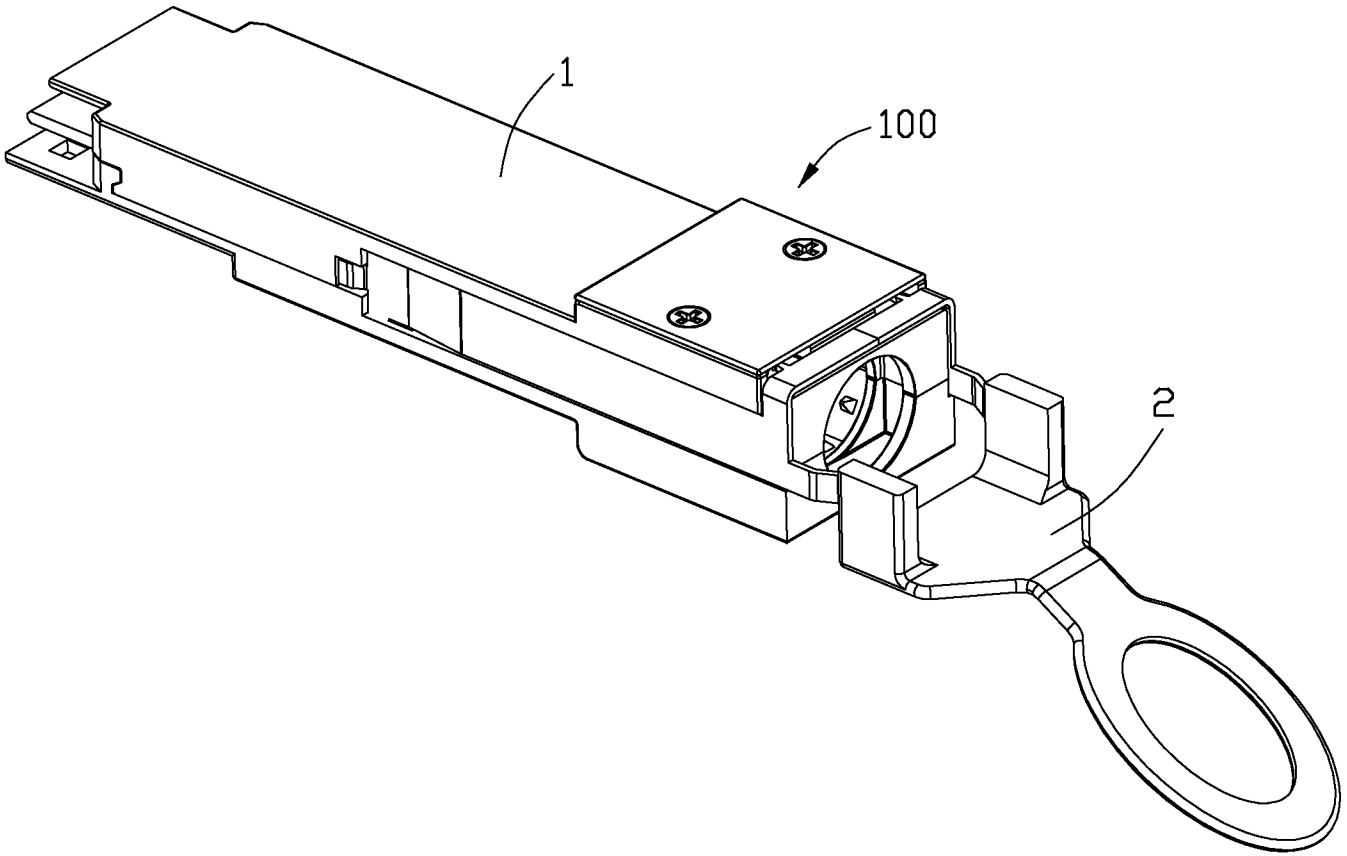
FIG. 1 is an assembled perspective view showing a plug connector having a releasing mechanism in accordance with the present invention.

Reference will now be made to the drawing figures to describe the present invention in detail.

Referring to FIG. 1, a plug connector 100 in accordance with the present invention comprises a housing 1 and a releasing mechanism 2 assembled to the housing 1. The housing 1 of the plug connector 100 has a front portion 11 adapted for being inserted into a module receptacle (not shown) having a latching tap (not shown), and a rear portion 12 configured for connecting with a cable (not shown). The plug connector 100 is configured for mating and latching with the module receptacle.

Figure 2:
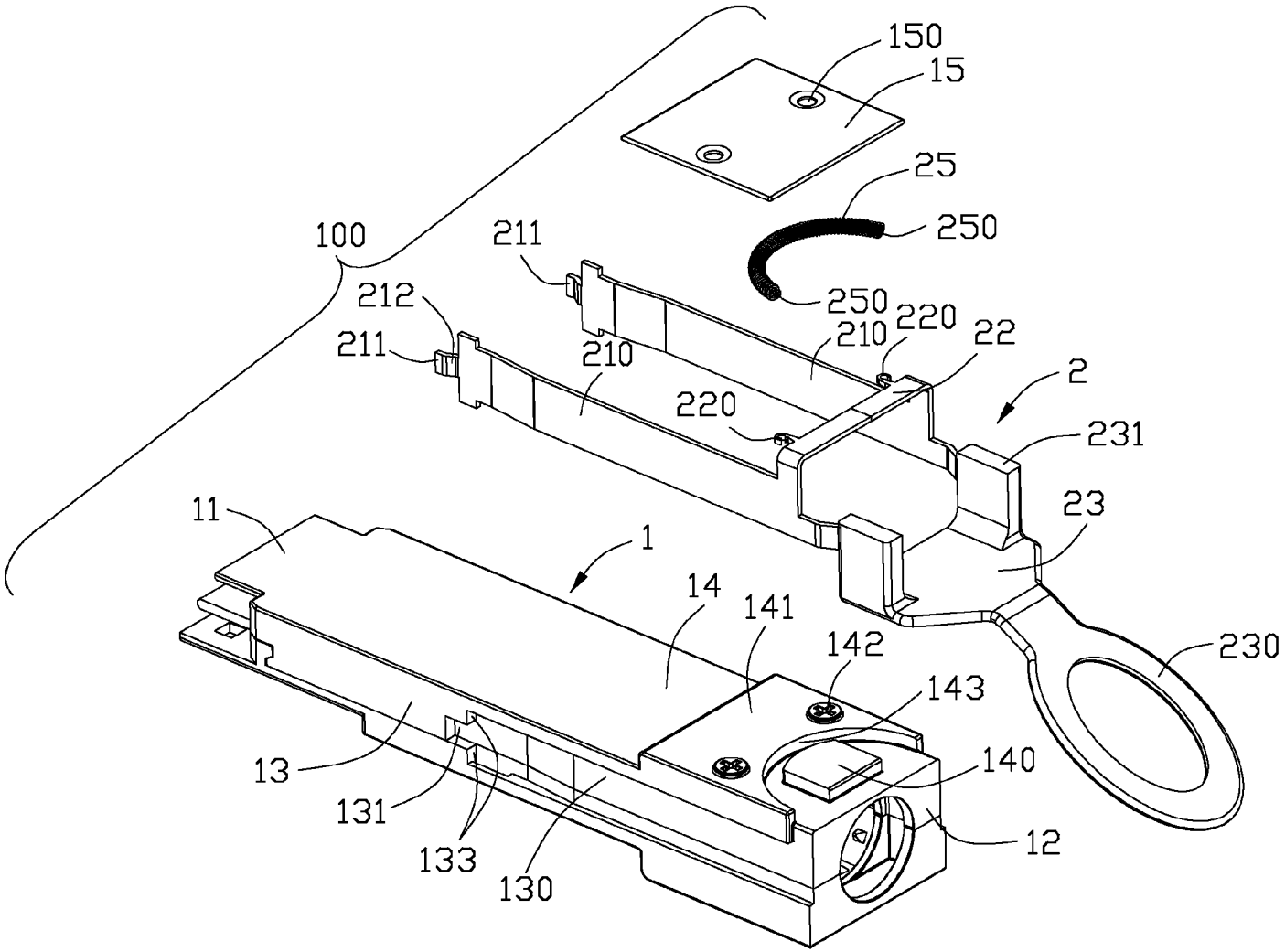
FIG. 2 is a partially exploded perspective view showing the plug connector as shown in FIG. 1.
Figure 3:
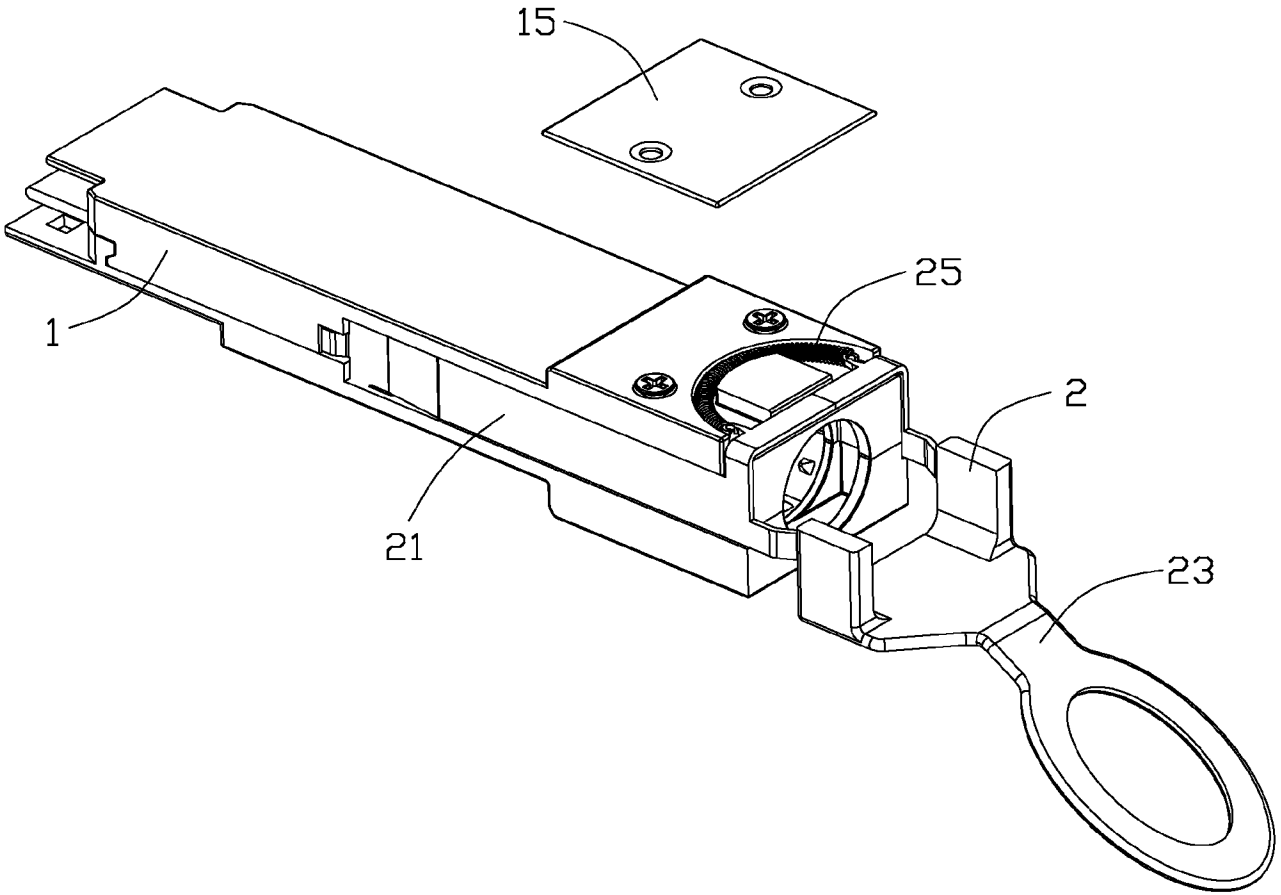
FIG. 3 is a perspective view showing the releasing mechanism in a latching position.
Figure 4:
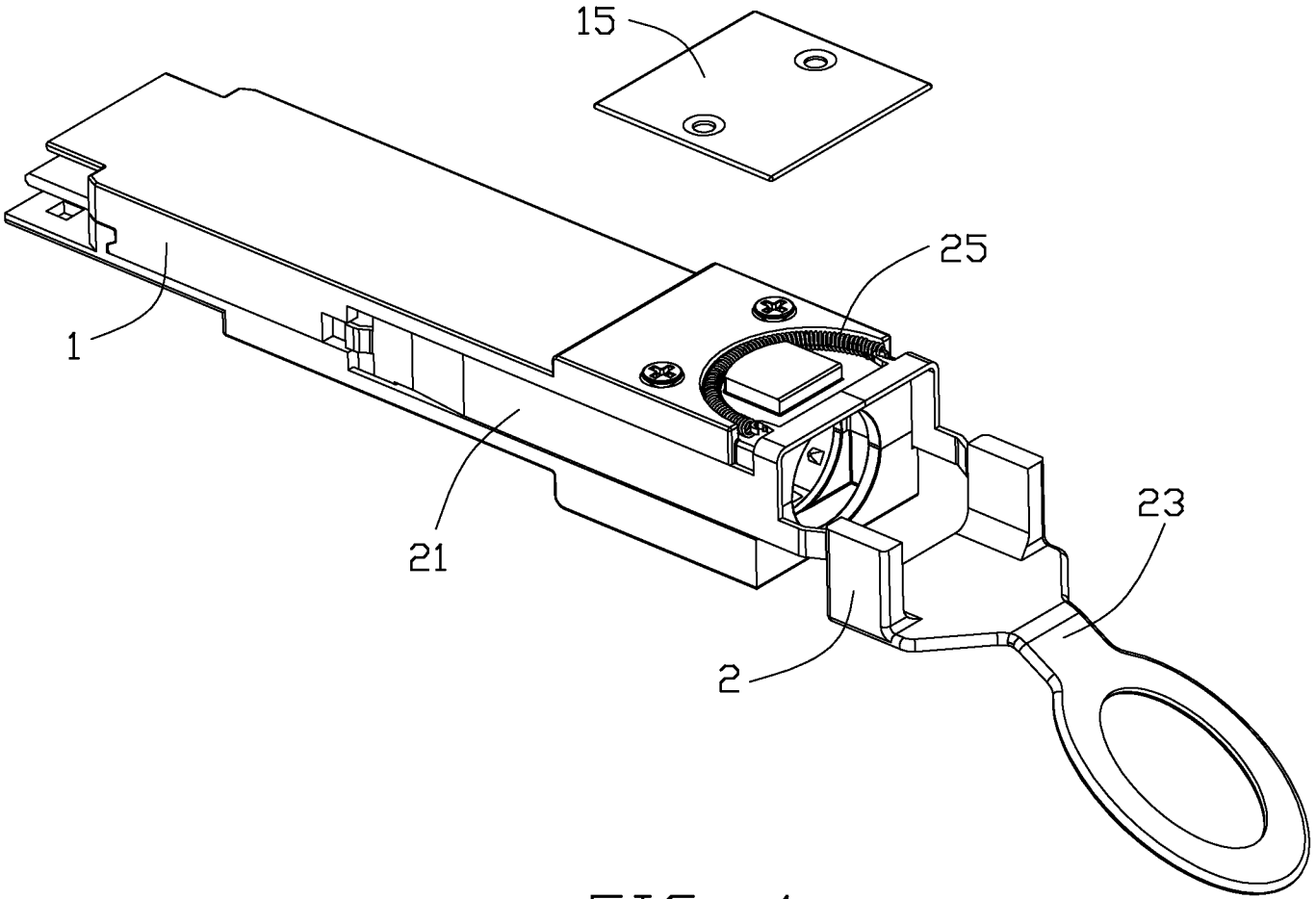
FIG. 4 is a perspective view showing the releasing mechanism in a releasing position.

Referring to FIGS. 2, 3 and 4, the housing 1 comprises a top wall 14 and two opposite sidewalls 13. The sidewall 13 defines an indentation 131 opening towards the rear portion 12. The sidewall 13 further defines an elongated recess 130 extending along a front-to-back direction from the indentation 131. The indentation 131 has a width smaller than that of the recess 130 to thereby form a shoulder portion 133 between the recess 130 and the indentation 131. The latching tap is elastically resisted against the shoulder portion 133 so that the plug connector 100 could be latched with the module receptacle.

The top wall 14 of the housing 1 further defines a front mounting portion 141 and a rear mounting portion 140. The front mounting portion 141 and rear mounting portion 140 define a curved slot 143 therebetween. A cover 15 is mounted onto the housing 1 adapted for covering the curved slot 143. The cover 15 defines at least one mounting hole 150 for receiving a screw 142. The screw 142 could be locked onto the front mounting portion 141 or rear mounting portion 140.

The releasing mechanism 2 comprises a pair of sliders 21 respectively attached to the sidewalls 13 and movable relative to the sidewalls 13 along a mating direction of the plug connector 100. Each of the sliders 21 includes a base portion 210 received in the recess 130, an actuating arm 22 sideward extending from the base portion 210, and an actuating end 211 positioned at the front end thereof. Both of the actuating arms 22 extend vertically from the base portion 210 along the sidewall 13 and at least partly positioned on the top wall 14. In another embodiment, the actuating arms 22 could be connected together as a bridge connecting the base portions 210. The actuating end 211 has a leading surface 212 extending outwardly and forwardly from the front of the base portion 210. The width of the actuating end 211 is narrower than the width of the slider 21. The actuating ends 211 are respectively received in the indentations 131.

The releasing mechanism 2 further comprises an extension spring 25 having two free ends 250 respectively locked with the actuating arms 22. Accordingly, the actuating arm 22 has a hook 220 adapted for hooking the free ends 250 directly. The extension spring 25 is mounted into the curved slot 143. The cover 15 shields the extension spring 25 for preventing the extension spring 25 escaping from the curved slot 143.

The sliders 21 move backwardly from a latching position to a releasing position would pull the extension spring 25 into an extended state. Meanwhile, the leading surface 212 of the sliders 21 could lead the latching tap moving outwardly and finally escaping from the shoulder portion 133. When the sliders 21 are pulled into the releasing position, the extended spring 25 could provide a return force to restore the sliders 21 to the latching position.

In the preferred embodiment, both the extension spring 25 and the curved slot 143 are configured to be a U-shaped configuration. In the second embodiment in accordance with the present invention, the extension spring 25 and the curved slot 143 could be respectively designed into a V-shaped configuration with the same effect.

The releasing mechanism 2 includes a pull member 23 having two connecting portions 231 respectively molding with the sliders 21. The pull member 23 further includes a ring-shaped pull portion 230. The pull member 23 is positioned at the bottom side of the housing 1. It is easy to be understood that the pull member 23 could be positioned at the top side of the housing 1 in another embodiment.

The releasing mechanism 2 has a simple structure. When the elasticity of the extension spring 25 is changed or lost, the extension spring 25 could be replaced from the releasing mechanism quickly in the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector configured for latching with a module receptacle having an inwardly extending latching tab, comprising:

a housing comprising a top wall defining a curved slot thereon, and two opposite sidewalls; and a releasing mechanism assembled to the housing and comprising:

a pair of sliders movably mounted to the sidewalls, each of the sliders comprising an actuating end adapted for releasing the latching tab of the module receptacle; and an extension spring mounted in the curved slot, the extension spring having two free ends respectively connected to the sliders and tending to restore to its original state in response to a pulling movement of the the sliders, wherein each slider includes an actuating arm extending sideward over the top wall, wherein the free ends of the spring are respectively locked with the actuating arms, the housing has a front mounting portion and an opposite rear mounting portion separately protruding from the top wall and defining the curved slot therebetween.

2. The plug connector as claimed in claim 1, wherein the actuating arm has a hook locking with the free end of the spring.

3. The plug connector as claimed in claim 1, the curved slot is defined as a U-shaped configuration.

4. The plug connector as claimed in claim 1, further comprising a cover mounted onto the top wall over the curved slot for preventing the extension spring from escaping the curved slot.

5. The plug connector as claimed in claim 1, wherein each of the sidewalls defines an elongated recess extending along a front-to-back direction, the slider having an elongated base portion received in the recess.

6. The plug connector as claimed in claim 5, wherein each of the sidewalls comprises an indentation at a front of the recess, said indentation having a width narrower than the recess and having a rearward opening for receiving the actuating end, a shoulder portion being defined between the indentation and the recess.

7. The plug connector as claimed in claim 6, wherein the shoulder portion is adapted for resisting the latching tap.

8. The plug connector as claimed in claim 7, wherein the actuating end extends outwardly and forwardly at the front of the base portion and has a leading surface adapted for releasing the latching tap from the shoulder portion.

9. The plug connector as claimed in claim 1, wherein the releasing mechanism further includes a pull member having two connecting portions respectively mounted to the sliders.

10. The plug connector as claimed in claim 9, wherein the pull member is positioned at a bottom side of the housing.

11. A plug connector comprising:

a housing confined defining opposite horizontal main surfaces and opposite vertical side surfaces perpendicular to each other to commonly form a front mating port for mating with a receptacle connector, and a rear connection port for connecting to a cable;

a releasing mechanism including:

a pair of metallic sliders located on two sides with respective actuating ends, respectively, and joined with each other via a transverse actuating arm unitarily linked between rear portions of said sliders; and a one-piece spring discrete from the sliders and the associated actuating arm, and defining two opposite end sections respectively linked to two spaced positions of the the actuating arm, wherein said spring is an extended spring located in front of the actuating arm, wherein the mounting portion defines a curved structure confronting the middle portion of the spring, wherein the spring and the actuating arm are located on one of the main surfaces while the pair of sliders are respectively located upon the side surfaces, further including a plastic pull member integrally formed with at least one of the actuating arm or the pair of sliders; wherein the housing defines a mounting portion to abut against a middle portion of the spring so as to restrain movement of the spring when the spring is actuated to move rearwardly by the actuating arm.

12. A plug connector comprising:

a housing confined defining opposite horizontal main surfaces and opposite vertical side surfaces perpendicular to each other to commonly form a front mating port for mating with a receptacle connector, and a rear connection port for connecting to a cable;

a releasing mechanism including:

a pair of metallic sliders located on two sides with respective actuating ends, respectively, and joined with each other via a transverse actuating arm unitarily linked between rear portions of said sliders;

a one-piece extendable spring discrete from the sliders and the associated actuating arm, and defining two opposite end sections thereof;

the opposite end sections being linked to one of the housing and the actuating arm in a spaced-apart manner, and a middle portion of the spring abutting against the other of the housing and the actuating arm so as to restrain movement of the spring when the spring is actuated to move rearwardly by the actuating arm; and a plastic pull member integrally formed with and essentially located behind the actuating arm, wherein the middle portion of the spring is configured in a symmetrical state with regard to the opposite two end sections either angularly or curvedly.

* * * * *